United States Patent [19]

Grimard

[11] 4,381,192

[45] Apr. 26, 1983

[54] FILTER BAG FOR VACUUM CLEANER

[76] Inventor: Jean P. Grimard, 9, rue du 11 Novembre, Saint-Genis-Laval, France, 69230

[21] Appl. No.: 258,316

[22] Filed: Apr. 28, 1981

[30] Foreign Application Priority Data

Apr. 30, 1980 [FR] France ..... 80 10128

[51] Int. Cl.[3] ..... B01D 46/02

[52] U.S. Cl. ..... 55/376; 55/378; 55/382; 55/DIG. 2

[58] Field of Search ..... 55/374, 376–378, 55/381–382, DIG. 2

[56] References Cited

U.S. PATENT DOCUMENTS

| | | | |
|---|---|---|---|
| 2,766,842 | 10/1956 | Hurd | 55/376 |
| 2,804,164 | 8/1957 | Brace | 55/376 |
| 2,815,090 | 12/1957 | Humphrey | 55/376 |
| 2,975,862 | 3/1961 | Goldberg . | |
| 3,675,399 | 7/1972 | Westergren | 55/377 X |
| 4,116,648 | 9/1978 | Busch | 55/276 |
| 4,257,789 | 3/1981 | Leinfelt | 55/378 |

FOREIGN PATENT DOCUMENTS

| | | | |
|---|---|---|---|
| 1124964 | 10/1956 | France . | |
| 2374005 | 7/1978 | France . | |
| 788578 | 1/1958 | United Kingdom | 55/378 |

*Primary Examiner*—Kathleen J. Prunner

*Attorney, Agent, or Firm*—Bacon & Thomas

[57] ABSTRACT

A vacuum cleaner is provided with an improved filter bag which is attached to a fixed part of the vacuum cleaner by a removable base member. The base member is adapted to allow the ingress and egress of a pipe which transports a gaseous fluid to be filtered, to the interior of the bag. Seal means are also provided for holding the pipe in sealing engagement with the base member and bag.

10 Claims, 13 Drawing Figures

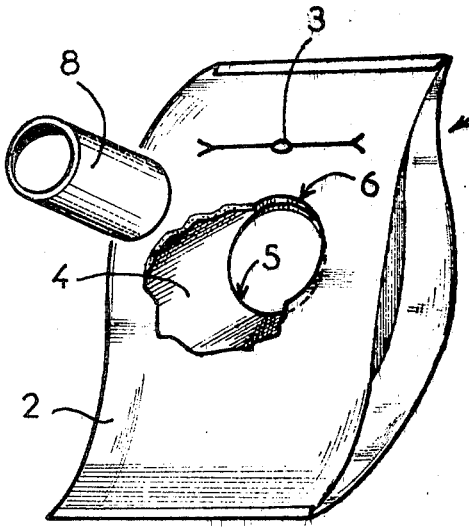
FIG.1
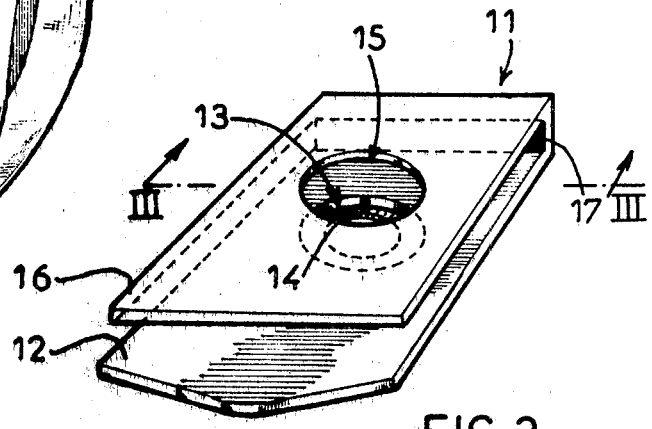
FIG.2
FIG.4
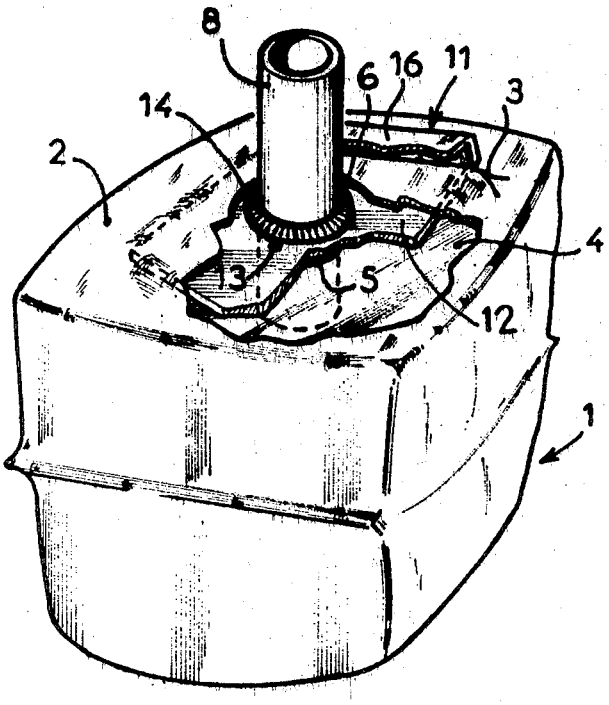

FIG.3
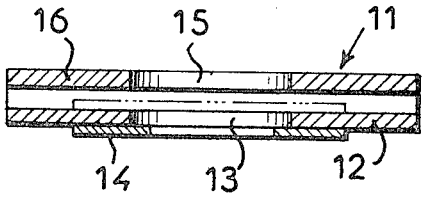
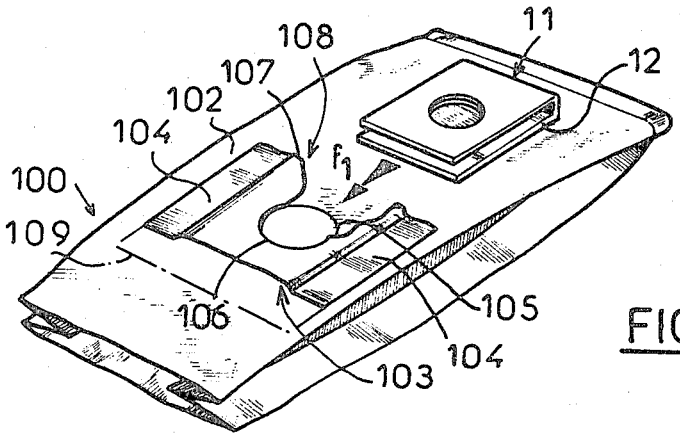
FIG.5
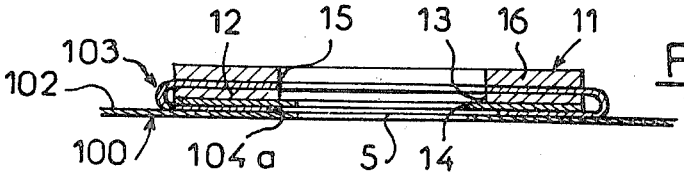
FIG.6
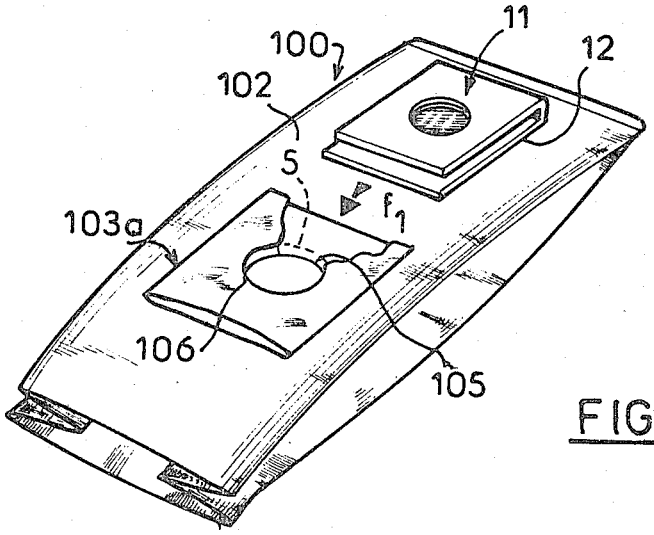
FIG.7

FIG.8
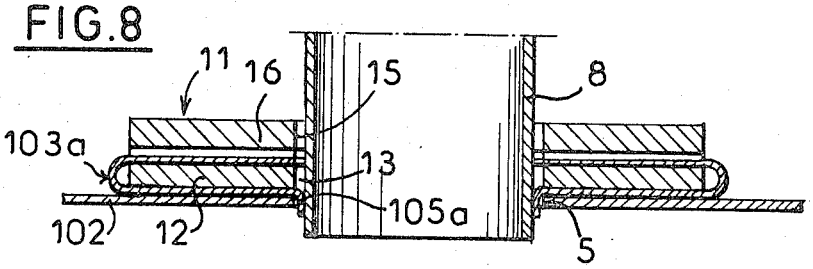
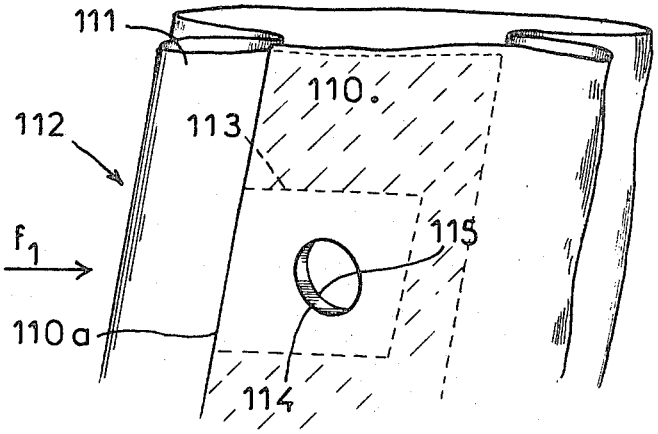
FIG.9
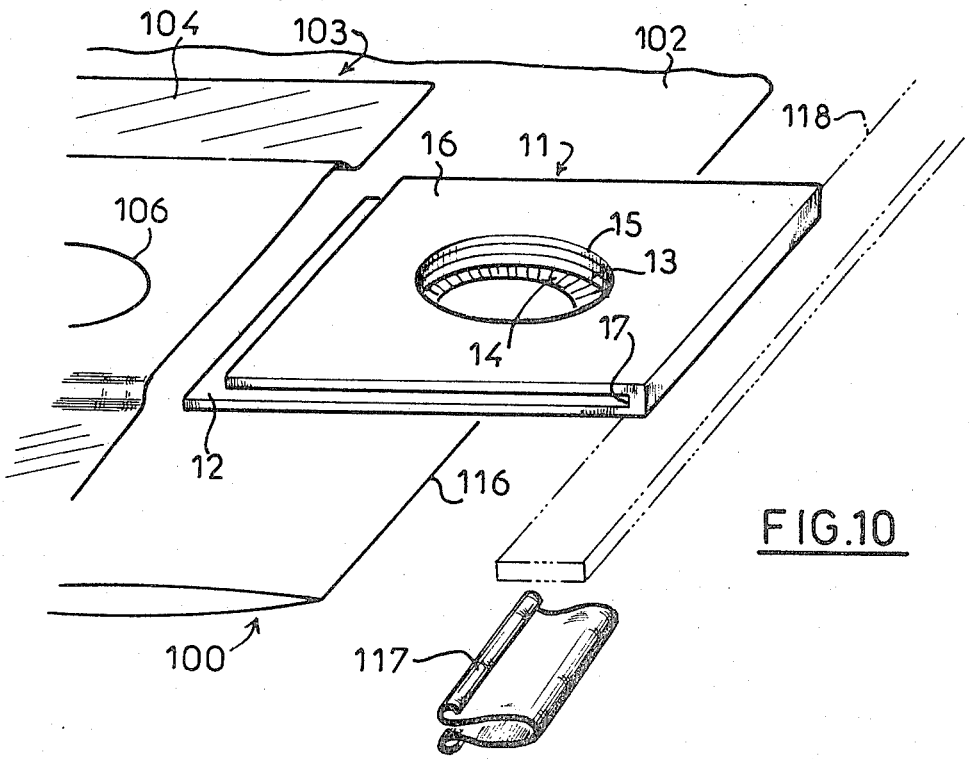
FIG.10

FILTER BAG FOR VACUUM CLEANER

The present invention relates to a filter bag for the retention of physical particles, one application of which constitutes a dust bag for a vacuum cleaner, which is permeable to fluids, essentially gaseous fluids, such as air for example, having at least one opening adapted to allow the introduction of a pipe through which the particle-laden fluid flows into the receptacle.

Known dust bags are generally constituted by an airpermeable part, adjoining a fixing base made of cardboard or like material, provided with an inlet opening for the dust-laden air, this base serving as support for the dust bag when it is placed in position in the vacuum cleaner.

This type of known base considerably complicates manufacture of the dust bag, thus increasing the costs thereof due to the necessity either of more man-power or of investments in special equipment, apart from the additional quantity of material which increases transport costs.

Other systems do not present this base adjoining the bag, but either their positioning is complex, hazardous or difficult, or they do not provide sufficient tightness at the orifices for introduction of the air inlet pipe, or the vacuum cleaner employing these known bases is unnecessarily complicated due to the placement and positioning requirements inherent in a removable, bag-retaining device.

It is an object of the present invention to remedy these drawbacks by producing and employing a simple dust bag, which is easy and economical to manufacture and is light, practical to use and which best performs the functions for which it is intended.

To attain the above aims, the invention is characterised in that:

(1) the rigid base is constituted by an independent piece forming a part for connection with a bag and a part adapted to be received in a receptacle of the vacuum cleaner, the connection part being perforated with a hole for passage of an air inlet pipe, (2) the bag comprises, two layers at least partly superposed and separated from each other, defining a space accessible through an opening appearing on the outer layer and corresponding to the width of the connection part of the base, said layers presenting two holes in register and adapted to coincide with that of the base after insertion of the connection part in the space through the opening, and;

(3) a sealing device is associated with the connection part inserted in the accessible space to and adapted to cooperate with the pipe.

The invention will be more readily understood on reading the following description with reference to the accompanying drawings, in which:

FIG. 1 is a perspective view, with parts torn away, of a bag according to a first variant embodiment.

FIG. 2 is a view in perspective of one of the elements constituting the bag according to the invention.

FIG. 3 is a transverse section taken, to a larger scale, along the plane III—III of FIG. 2.

FIG. 4 is a perspective view, with parts torn away, showing the association of the constituent elements according to FIGS. 1 and 2.

FIG. 5 is a view in perspective, with parts torn away, illustrating a variant embodiment of one of the elements constituting the invention.

FIG. 6 is a transverse section showing, to a larger scale, a variant embodiment of certain of the elements of the invention.

FIG. 7 is a perspective view, with parts torn away, showing another embodiment of the object of the invention.

FIG. 8 is a transverse section, to a larger scale, showing one of the features of the object of FIG. 7.

FIG. 9 is a partial perspective view showing, on a different scale, another embodiment of one of the elements constituting the invention.

FIG. 10 is a partial perspective view showing, to a larger scale, another embodiment of certain of the means of the invention.

Figure 11:
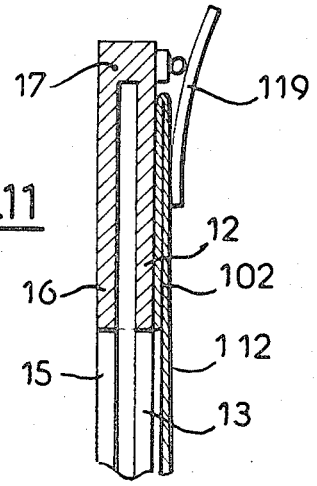
FIG. 11 is a transverse section showing a variant emboment of certain of the constituent elements of FIG. 10.

Referring now to the drawings, FIG. 1 shows a first embodiment of a bag according to the invention. Such a bag, for example made of filter paper, may be of the type in the form of an envelope having two closed ends. The envelope of the type with two thicknesses and thus comprises, in one of the parts of the walls, an outer layer 2 with a cut-out 3 and a circular opening 6. In cooperation therewith, the envelope has a second layer 4, called an inner layer, having an opening 5 which is placed in register with the opening 6 of the layer 2. The openings 5 and 6 are of such dimensions as to allow the passage of a pipe 8 for circulation of dust-laden air.

FIGS. 2 and 3 show, to a larger scale, that, according to the invention, the bag described hereinabove is completed by a base 11 made of rigid material such as compact cardboard, plastics or any suitable material. The base 11 comprises two parts 12 and 16 extending, according to the example illustrated, in the same direction, substantially parallel, from a common bottom 17. The part 12 for connection with the bag, or so-called connection part, has a width slightly less than the length of the cut-out 3, so as to be able to be inserted in the latter and be disposed in the space between the layers 2 and 4. The so-called adaptation part 16 preferably has a length less than part 12 and is adapted, to cooperate with a fixed part of the vacuum cleaner.

The part 12 has an opening 13 provided with sealing means 14 which may, in known manner, be a lip made of thin, elastically deformable material. The seal 14 may be added on the outer face of the part 12 or on the inner face as shown in dashed and dotted lines in FIG. 3. The part 16 presents an opening 15 coaxial with respect to opening 13. The openings 13 and 15 are provided to allow passage of the pipe 8 and the seal 14 is provided to surround such a pipe with elastic deformation.

According to the invention, adaptation of the abovedescribed means is effected (FIG. 4) by ensuring insertion of the part 12 of the base 11 in the cut-out 3. The part 12 is thus inserted in the space between the layers 2 and 4, up to a position in which the openings 13 and 15 coincide with the openings 5 and 6.

The bag 1 equipped as provided hereinabove may be mounted, disposed or placed in the receptacle or the compartment provided to receive it, for example of a vacuum cleaner. The part 16 is adapted on the fixing means which are provided to this end, for example around an orifice for passage in the compartment through which the pipe 8 projects. When the compartment of the vacuum cleaner is closed, the pipe 8 simultaneously passes through at least the openings 15 and 6 to cooperate with the device 14 which surrounds the pipe 8 in the manner of a lip. This results in a seal opposing any return of the fluid or dust-laden air introduced into said bag, towards the outside.

FIG. 4 shows that the inflation of the bag 1, under the effect of the introduction of a flow of particle-laden air, has for its effect to apply the layer or thickness 4 under the part 12 and the seal 14 about the pipe 8. Consequently, this enables a seal to be made between the opening 5 and the pipe 8.

Apart from this first function, it should be noted that part 12 represents, for the wall layer or thickness 4, a support and a stop opposing any tendency to an exaggerated deformation of said wall in a zone where the latter would not encounter sufficient support by the walls defining the compartment.

A third function of the arrangement according to the invention resides in that part 16 constitutes a removable adaptation and support element of the bag on the fixing means provided to this end in the receiving compartment of the vacuum cleaner.

When the bag is filled with waste, dust, etc. which has been retained, the compartment may be opened to allow disengagement of the pipe 8 either automatically or by extraction by hand. This disengagement enables the base 11 to be released from the compartment and the full bag 1 to be extracted. The vacuum cleaner is refitted with a new bag at the opening 3 of which the base 11, previously disengaged from the used bag, is reinserted to reconstitute the cooperating means in order to perform the functions described hereinabove.

According to the invention, the base 11 is consequently rendered independent of the bag and may be removed from a full bag to refit an empty bag. This makes it possible to make a particularly well-finished base 11 and, in particular, to provide it with all the fittings adaptable, on the one hand, as a connection between the bag and the vacuum cleaner when the bag is assembled within the vacuum cleaner and, on the other hand, for an efficient seal with respect to the inlet pipe for the dust-laden air.

This results in a noteworthy saving in manufacture and costs of raw material of the disposable bags for vacuum cleaners and the possibility of facilitating manufacture of such bags with a view to decreasing manufacturing costs, since present operations of fitting the base are long and expensive.

Another advantage resides in the fact that, by means of such a solution, it is no longer necessary to provide a pipe 8 itself provided with a sealing device as is sometimes the case in certain present arrangements. In this respect, it should be considered that the seal 14 might also be added directly on the bag.

FIG. 5 shows a variant embodiment according to which the bag, according to the invention, generally designated by reference 100, is provided, on the outer face of its peripheral wall and, for example, on the part referenced 102, with a strip 103 which may be added by adhesion or by any other means along two lateral zones 104. The strip 103 is consequently free with respect to the part 102 which it covers and defines, with the latter, the space existing in the preceding embodiment between the layers 2 and 4. Part 102, covered by the strip 103, is provided with an opening 105 with which an opening 106 of strip 103 is placed in register.

Consequently, such an arrangement makes it possible, with one of the edges of the strip 103, for example end edge 107, to define, with the covered part 102, an opening 108 allowing the introduction, in the direction of arrow $f_1$, of a base 11 of the type described with reference to FIG. 2.

The embodiment illustrated in FIG. 5 makes it possible to simplify production of the bag 100 and to reduce further the manufacturing cost thereof, whilst providing a product responding to the characteristics of holding and sealing the inserted pipe 8.

FIG. 5 shows that the connection between the strip 103 and the part 102 may employ, for example, adhesion at the other end edge 109, such as shown in dashed and dotted lines. Such a connection further improves the seal established between part 102 and the segment of pipe 8 passing therethrough.

FIG. 6 corresponds to a variant embodiment consisting in ensuring adaptation of the strip 103 via lateral zones **104*a* which are turned inwardly. This makes it possible to give the space which is thus made for receiving the part 12 of the base 11 a useful thickness compatible with the receiving and sliding of said part 12**.

FIG. 7 shows a preferred embodiment in which the strip 103 is made in the form of a segment of section or tubular envelope **103*a*, flattened by folding, and connected by one of the flat portions to the part 102 of the bag 100**.

The tubular segment **103*a* is connected, particularly by adhesion, on the outer face of the part 102 which represents the inner layer. The upper flat part of the segment 103*a* constitutes the upper layer. The two flat parts of the segment 103*a* define the space in which the part 12 of the base 11 can be inserted, by sliding in the direction of arrow $f_1$. One or the other of the open transverse ends of the segment 103*a* represents an opening 108 performing the function of cut-out 3**.

The upper flat part of the segment **103*a* is provided with an opening 106, whilst the lower flat part is provided with an opening 105 for engagement of the pipe 8. The opening 105 is placed, in position of use, opposite an opening 5 made in the part 102** of the bag.

Such an embodiment facilitates manufacture of the bag and offers the advantages of simplicity, efficiency and facility of production and use.

The segment **103*a* may be made of any suitable material. However, it appears preferable to utilize a plastic material, of small thickness, such as polyethylene. In fact, as shown in FIG. 8, it then becomes possible to make the opening 105 with a diameter slightly smaller than that of the pipe 8. Thus, during cooperation, the lower flat part forms, by its part bordering the opening 105, a sort of peripheral lip 105*a*, surrounding the pipe 8 which may just be engaged or pass through with respect to said opening. The lip 105*a* thus performs a function of seal, replacing the device 14** which no longer has to be provided.

FIG. 9 shows another variant embodiment in which the delimitation of the space and of the opening for engagement of the part 12 are obtained by using the longitudinal edges or borders 110 and 111 of a strip of filter material folded on itself to form a tubular envelope 112. Such an envelope represents, after cutting to the desired length, a bag whose transverse ends are closed by folding and/or gluing for example. In such a case, the covering part 110 and the covered part 111 define an overlapping zone which is at least equal to, if not greater than, the length of the part 12. In addition, the borders 110 and 111 are connected together by any suitable means, particularly by gluing, as shown in the form of hatching in the drawings, so as to leave a housing 113, as defined by broken lines, similar to the space of the preceding examples. The housing 113 is accessible by the corresponding longitudinal edge 110*a* of the covering part 110, which is not rendered fast with the outer surface of the covered part 111.

Thus, in this embodiment, a base 11 may be introduced by inserting part 12 in the direction of arrow $f_1$, shown in the drawing. The openings 13 and 15 of parts 12 and 16 are thus brought into register with openings 114 and 115 which are made to this end in parts 110 and 111.

FIG. 10 illustrates a variant embodiment according to which it may be provided to give the base 11 a sufficient length so that the bottom 17 for connection between the parts 12 and 16 is, after suitable positioning and insertion in the receiving space, disposed near one of the edges or a fold made by the bag, such as the one designated by reference 116 in FIG. 10. The superposition of the bottom 17 and of the edge 116 may be used to ensure a firm and resistant holding and connection, particularly via an elastic clip 117.

In a variation, not shown, of FIG. 10, the base 11 may be immobilised in a firm position to cooperate with the clip 117 for fixing the bag inside the compartment without using the piece 103–103*a* or 110 for this function.

FIG. 10 shows, in dashed and dotted lines, that the bottom 17 may be arranged to be provided with a small bar 118 having, for example, a length substantially equal to the width of the bag. It thus becomes possible to use the bar 118 and the clip 117 simultaneously to strengthen the position of the base on the bag and to close the latter when the edge 116 represents, for example, the open mouth of the bag. Such a means enables the manufacturing costs of a bag to be considerably reduced, since only one operation of transverse closure is then necessary, the second closure being made by the user when positioning it.

Figure 12:
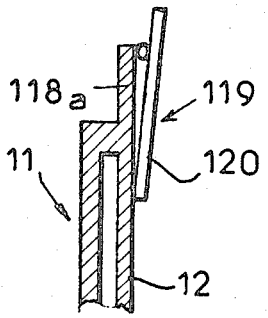
FIG. 12 is a partial section showing, on a different scale, a development of the object of FIG. 11.

FIG. 11 illustrates another variant embodiment, according to which one of the parts of the base 11, for example part 12, directly forms or comprises, associated therewith, an articulated clip 119 adapted to clip the edge 116. An equivalent embodiment, from the technical point of view, is shown in FIG. 12. According to the latter, the clip 119 is formed by a part 120 articulated on a small bar 118*a* which is formed by the base 11 from the bottom 17 and in the plane of part 12.

Figure 13:
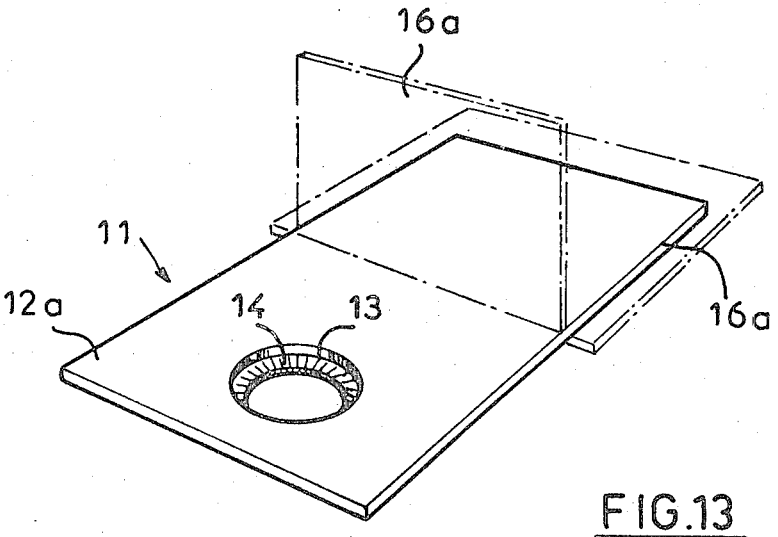
FIG. 13 is a perspective view illustrating another embodiment of one of the elements constituting the object of the invention.

FIG. 13 shows that the base 11 may also comprise a part 12*a* for connection with the bag and a part 16*a* for adaptation extending in the same plane. In such a case, only the part 12*a* then presents an opening 13 possibly bordered by a seal 14. Such an embodiment may be rendered necessary according to the structure of the fixing means. The part 16*a* may also be shaped differently from part 12*a*, as illustrated in dashed and dotted lines. Similarly, a different relative orientation may be given to the two parts, for example an arrangement at right angles.

The invention is not limited to the examples described and shown, as various modifications as may be made without departing from the scope thereof.

What is claimed is:

1. In a vacuum cleaner, the combination comprising:

(a) a filter bag made of filtering material, said bag defined by superposed inner and outer layers that are separated from each other to provide a space between said layers;

(b) means for providing access to said space between said layers;

(c) an inlet pipe connected with said vacuum cleaner and said filter bag;

(d) said inner and outer layers provided with concentric openings which receive said inlet pipe for conveying fluid to be filtered to the interior of the filter bag;

(e) a rigid base member removably attached to the vacuum cleaner and having at least a first part thereof received in said accessible space and extending through said means for providing access to said space;

(f) said base member including another part which constitutes a support element for engaging the vacuum cleaner and supporting said bag within the vacuum cleaner;

(g) each part of said base member including an opening located substantially in alignment with said concentric bag openings;

(h) flexible seal means connected to the periphery of at least one of said openings and extending circumferentially inwardly from said periphery; whereby, said seal means extends in sealing engagement with said inlet pipe when said inlet pipe is received into said aligned openings.

2. The vacuum cleaner of claim 1 wherein said space between said layers is defined by a strip of material attached to said inner layer and said outer layer is defined by said strip.

3. The vacuum cleaner of claim 2, wherein said strip is attached to said inner layer along at least two edges of said strip.

4. The vacuum cleaner of claim 3, wherein said at least two edges are folded inwardly and attached to said inner layer.

5. The vacuum cleaner of claim 2, wherein said strip is a segment of flattened tubular envelope.

6. The vacuum cleaner of claim 5, wherein said flattened tubular envelope is in sealing engagement with said inlet pipe when said inlet pipe is received in said concentric openings.

7. The vacuum cleaner of claim 1, wherein said inner and outer layers are defined by two longitudinal edges of said bag which mutually overlap and are secured to each other to define said accessible space by an edge portion of a first one of said two longitudinal edges which is unsecured to a second longitudinal one of said two edges.

8. The vacuum cleaner of claim 1, wherein said rigid base member includes a bottom part connected to said first part and said another part, and said flexible seal means are connected to the periphery of said opening in said first part.

9. The vacuum cleaner of claim 1 or 8 wherein said rigid base member includes a bar connected to said filter bag by a clip.

10. The vacuum cleaner of claim 9 wherein said clip is defined by a third part articulated on said bar.

* * * * *